US006456811B1

(12) United States Patent
Kato

(10) Patent No.: US 6,456,811 B1
(45) Date of Patent: Sep. 24, 2002

(54) TONER BOTTLE

(75) Inventor: Shuichi Kato, Tokyo (JP)

(73) Assignee: NEC Corporation (JP)

( * ) Notice: Subject to any disclaimer, the term of this patent is extended or adjusted under 35 U.S.C. 154(b) by 0 days.

(21) Appl. No.: 09/976,789

(22) Filed: Oct. 12, 2001

(30) Foreign Application Priority Data

Oct. 13, 2000 (JP) ..... 2000-312851

(51) Int. Cl.[7] ..... G03G 15/08
(52) U.S. Cl. ..... 399/262; 222/DIG. 1
(58) Field of Search ..... 399/262, 260, 399/258, 120; 222/DIG. 1, 167, 325; 141/346, 363, 383

(56) References Cited

U.S. PATENT DOCUMENTS 5,867,757 A * 2/1999 Okazaki et al. ..... 399/262
6,256,469 B1 * 7/2001 Taniyama et al. ..... 399/258
6,298,208 B1 * 10/2001 Kawamura et al. ..... 399/262

FOREIGN PATENT DOCUMENTS

JP 10-207207 8/1998

* cited by examiner

*Primary Examiner*—Sophia S. Chen
(74) *Attorney, Agent, or Firm*—Dickstein, Shapiro, Morin & Oshinksky, LLP

(57) ABSTRACT

A toner bottle is provided with a cylindrical bottle portion with an opening at one end, a cylindrical cap holding portion connected to the opening of the bottle portion, and a cap member attached to the cap holding portion in a manner enabling itself to slide in the peripheral direction and the axial direction of the cap holding portion. Toner is housed in the cylindrical bottle portion. The cap holding portion has a cylindrical body with a toner supply port formed for emitting the toner housed in the bottle portion, and a latching claw projecting from the outer surface of the cylindrical body at a position higher than the toner supply port. First and second grooves extending in the peripheral direction to which the latching claw is latched are formed in the inner surface of the cap member. An opening from which the toner housed in the bottle portion is emitted is formed to the cap member between the first and second grooves.

11 Claims, 6 Drawing Sheets

TONER BOTTLE

BACKGROUND OF THE INVENTION

1. Field of the Invention

The present invention relates to a toner bottle for supplying toner to a development apparatus to be used for development in copying machines, printers, facsimiles and the like.

2. Description of the Related Art

A conventional toner bottle for supplying toner to a development apparatus has a toner supply port for smoothly supplying toner into a development apparatus. The toner supply port of the toner bottle is normally closed by an adhesive sheet. Therefore, when supplying toner to a development apparatus, the adhesive sheet must be peeled.

In a series of operations for peeling the adhesive sheet, in some cases, toner in the toner bottle splashes and stains the periphery. In addition, since the toner bottle is handled in a condition where the toner supply port is left opened when attaching or detaching the toner bottle to or from the development apparatus, the toner may spill. Furthermore, when attaching the toner bottle to a development apparatus, hands or the periphery may be stained by mistake.

Recently, equipment with a development apparatus such as printers, facsimiles and the like has become common, and various people operate development apparatuses. Therefore, a demand for development of an inexpensive toner bottle which can be easily operated has increased.

In Japanese Unexamined Patent Publication No. Hei 10-207207, a toner bottle having a shutter that is made from an elastic material and rotatively disposed is disclosed. In this conventional toner bottle, the shutter opens when the bottle is attached to a toner supplying means, however, at any other time than this, the toner supply port of the toner bottle is closed by the shutter. The supply port of the toner bottle is securely closed by elastic deformation of the shutter, whereby toner leakage is prevented.

However, in the abovementioned conventional toner bottle, when the toner bottle is taken out from the development apparatus, if the shutter is touched by mistake, the opening of the shutter and the toner supply port of the toner bottle coincide with each other, and toner splashes to the outside.

Other proposals for toner bottles have also been made in which the toner supply port is mechanically opened and closed, and the toner supply port is closed by an elastic material. However, there are problems in these cases such as an increase in cost, difficult operations, and the like.

SUMMARY OF THE INVENTION

The object of the invention is to provide a toner bottle in which toner leakage and spillage can be prevented when the toner bottle is attached to a development apparatus. Another object of the invention is to provide a toner bottle in which toner that has remained inside when the toner bottle is detached from a development apparatus is prevented from leaking.

A toner bottle according to the present invention comprises a cylindrical bottle portion with an opening at one end, a cylindrical cap holding portion connected to the opening of the bottle portion, and a cap member attached to the cap holding portion in a manner enabling itself to slide in the peripheral direction and the axial direction of the cap holding portion. Toner is housed in the cylindrical bottle portion. The cap holding portion has a cylindrical body with a toner supply port formed for emitting the toner housed in the bottle portion, and a latching claw projecting from the outer surface of the cylindrical body at a position higher than the toner supply port. First and second grooves extending in the peripheral direction to which the latching claw is latched are formed in the inner surface of the cap member. An opening from which the toner housed in the bottle portion is emitted is formed to the cap member between the first and second grooves.

According to the present invention, before the toner bottle is attached to a development apparatus, the toner supply port is closed by the cap member. When attaching the toner bottle to a development apparatus, strong pressing makes the cap member slide, and the toner supply port of the toner bottle and the opening of the cap member coincide with each other.

When the toner bottle is taken out from the development apparatus, by rotating the toner bottle, the opening of the cap member and the toner supply port of the cylindrical body deviate from each other, and the toner supply port is closed by the cap member.

The cap member may be structured so as not to rotate reversely, so that the opening and toner supply port never coincide with each other again.

Thus, the operation of the toner bottle according to the present invention is easy. In addition, the toner bottle according to the present invention can be manufactured at a low cost. Furthermore, splash of the toner when the toner bottle is attached and detached can be prevented. Therefore, hands and the periphery can be prevented from being stained.

DETAILED DESCRIPTION OF THE PREFERRED EMBODIMENTS

Figure 1:
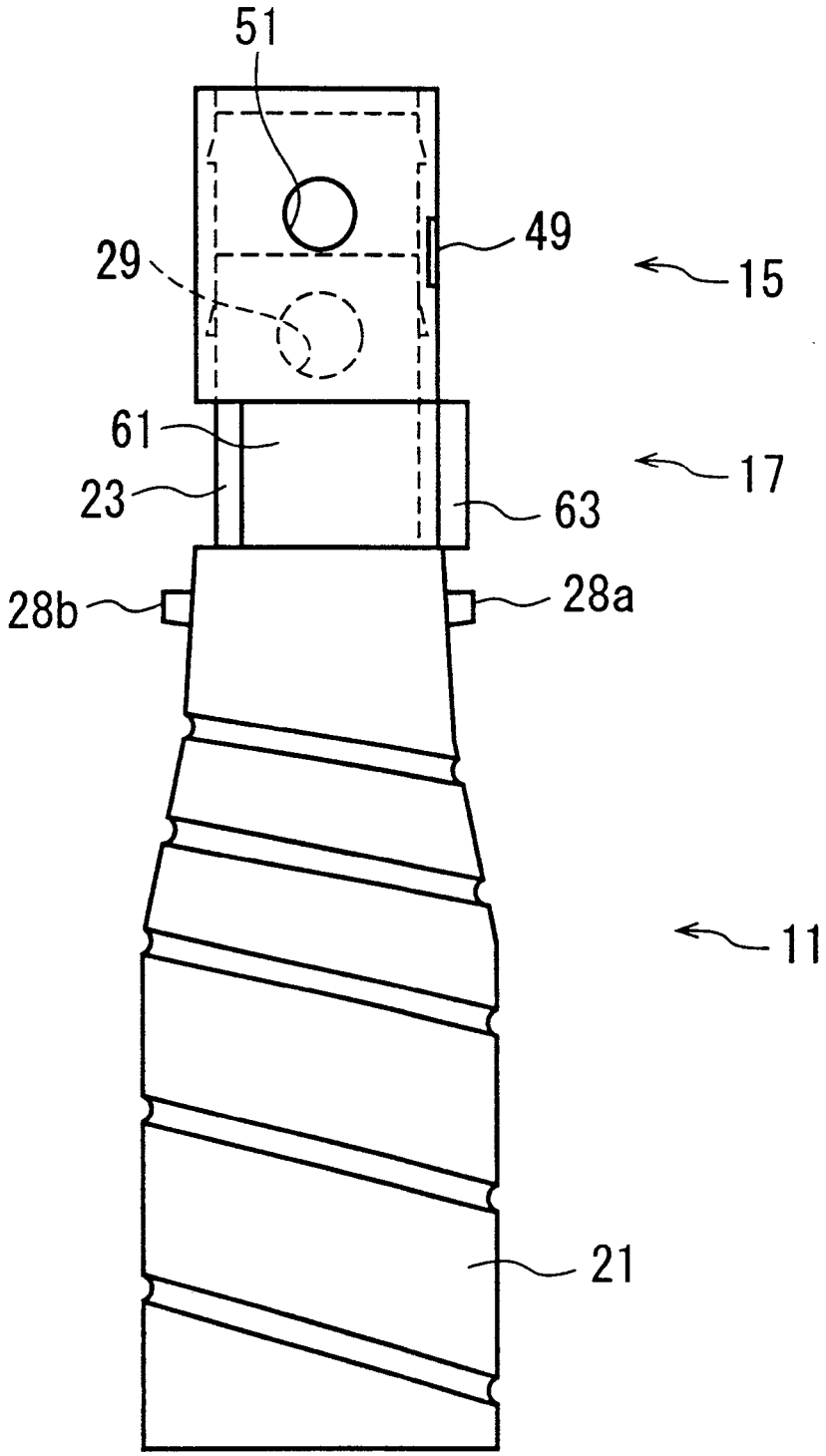
FIG. 1 is a front view showing a toner bottle according to an embodiment of the present invention.

Hereinafter, a preferred embodiment of the invention is explained in detail with reference to the attached drawings. FIG. 1 is a front view showing a toner bottle according to an embodiment of the present invention. In FIG. 1, a condition of an unused toner bottle is shown.

The toner bottle according to the present embodiment is provided with a bottle main body 11, a cap member 15 for covering an opening of the bottle main body 11, and a stopper member 17 for stopping movement of the cap member 15.

Figure 2:
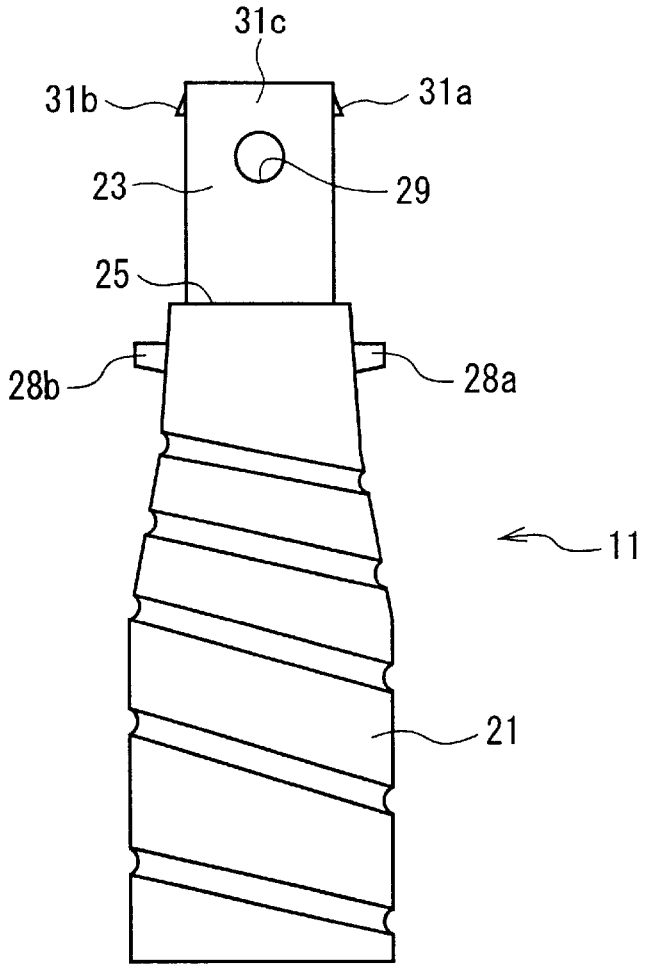
FIG. 2 is a front view showing a bottle main body 11.

FIG. 2 is a front view showing the bottle main body 11. The bottle main body 11 may be provided with a nearly cylindrical bottle portion 21 whose bottom is closed, and a cylindrical cap holding portion 23 connected to the upper opening end of the bottle portion 21. To the cap holding portion 23, the cap member 15 is attached in a manner enabling itself to slide in the peripheral direction and axial direction of the cap holding portion 23.

The outer diameter of the cap holding portion 23 is smaller than the inner diameter of the upper opening end of the bottle portion 21. Therefore, a stepped portion 25 is formed between the bottle portion 21 and cap holding portion 23. The connecting portion between the upper opening end of the bottle portion 21 and the lower end of the cap holding portion 23 is made from the same material as that of the bottle portion 21 and cap holding portion 23.

On the outer circumferential surface at the upper part of the bottle portion 21, a plurality of projections 28*a* and 28*b* are studded along the peripheral direction. The cap holding portion 23 is provided with cylindrical body 31*c*, and at the upper part of this cylindrical body 31*c*, toner supply port 29 for discharging toner housed in the bottle portion 21 outward is formed. Toner emitted from this toner supply port 29 is supplied to the development apparatus. A plurality of latching claws 31*a* and 31*b* are projectingly provided on the outer circumferential surface near the upper end of the cylindrical body 31*c*. The latching claws 31*a* and 31*b* are shaped into, for example, roughly triangular prisms so that the projection amount becomes smaller toward the upper side.

Figure 3:
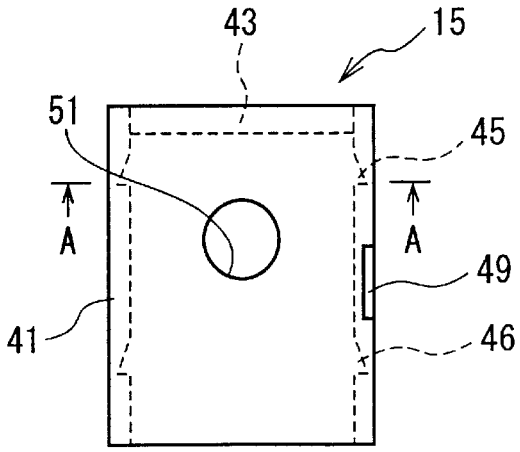
FIG. 3 is a front view showing a cap member 15.

FIG. 3 is a front view showing the cap member 15.

Figure 4:
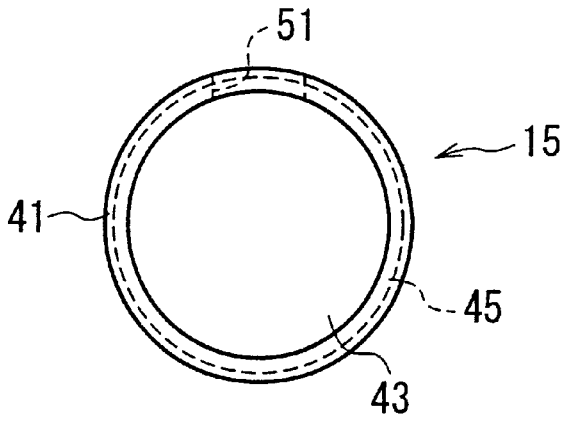
FIG. 4 is a plan view showing the cap member 15.

FIG. 4 is a plan view showing the cap member 15. The cap member 15 is provided with a cylindrical cap frame 41 and a cap top plate 43 closing the upper end of the cap frame 41.

The inner diameter of the cap frame 41 almost coincides with the outer diameter of the cap holding portion 23. The dimension in the axial direction of the cap frame 41 almost coincides with the dimension in the axial direction of the cap holding portion 23.

In the inner surface of the cap frame 41, a first circular groove 45 and a second circular groove 46 are formed along the peripheral direction. The first groove 45 is positioned at the cap top plate 43 side of the cap frame 41. The second groove 46 is positioned at the lower end side of the cap frame 41. The grooves 45 and 46 become shallower toward the upper side, and the latching claws 31*a* and 31*b* are latched in the grooves 45 and 46. The first groove 45 and second groove 46 are formed in parallel to each other. A notched portion 49 is formed at a part of the outer circumferential surface of the cap frame 41.

Opening 51 is formed to the cap frame 41 between the first groove 45 and second groove 46. The opening 51 is positioned nearer to the first groove 45 rather than the second groove 46. When the position of the opening 51 coincides with the position of the toner supply port 29, it becomes possible to supply toner housed inside the bottle portion 21 to a development apparatus.

Figure 5:
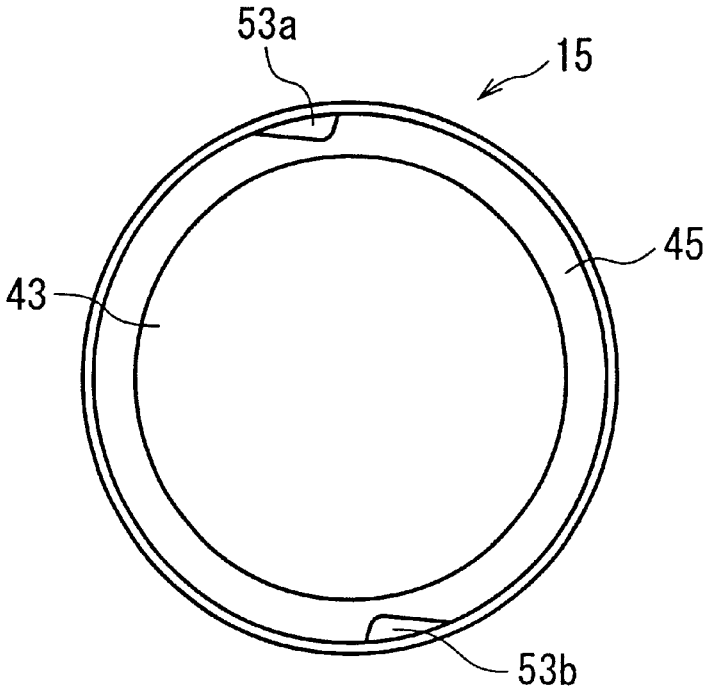
FIG. 5 is a sectional view along the A—A line in FIG. 3.

FIG. 5 is a sectional view along the A—A line in FIG. 3. In the first groove 45, a plurality of claws 53*a* and 53*b* are formed so as to project inward from the lower end of the first groove 45. In FIG. 5, the two claws 53*a* and 53*b* oppose each other in the diameter direction. Furthermore, either one of claw 53*a* or 53*b* is positioned, for example, immediately above the opening 51.

Figure 6:
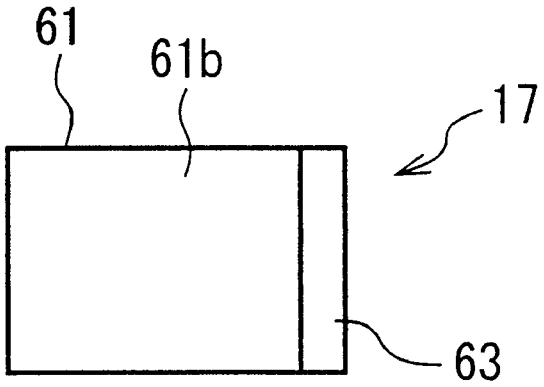
FIG. 6 is a front view showing a stopper member 17.
Figure 7:
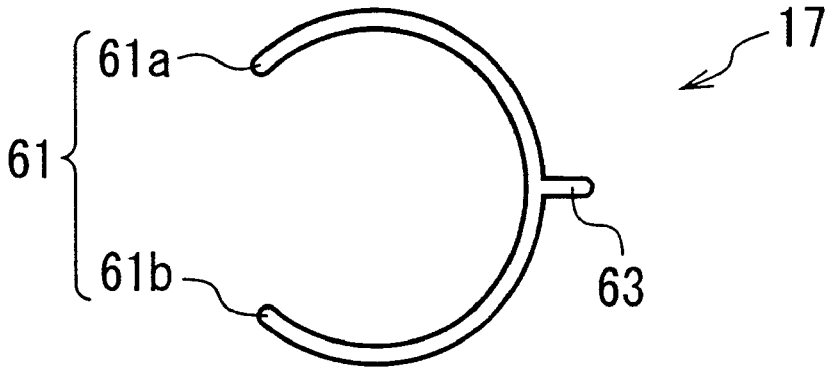
FIG. 7 is a plan view showing the stopper member 17.

FIG. 6 is a front view showing the stopper member 17. FIG. 7 is a plan view showing the stopper member 17. The stopper member 17 is made from, for example, a resin material having elasticity. The stopper member 17 is provided with a C-shaped stopper portion 61 to be attached to the outer circumferential surface of the cap holding portion 23 in an elastic manner, and a handle 63 projecting outward from the intermediate portion of the stopper portion 61.

The stopper portion 61 has a form along the outer circumferential surface of the cap holding portion 23, and is comprised of a pair of arms 61*a* and 61*b* extending in an arc shape from the handle 63. By pressing the front ends of the arms 61*a* and 61*b* against the outer circumferential surface of the cap holding portion 23 from the opening portions between the arms 61*a* and 61*b*, the stopper member 17 is attached to the cap holding portion 23 along the outer circumferential surface between the lower end of the cap member 15 and the stepped portion 25 of the bottle portion 21. In addition, to remove the stopper member 17 from the cap holding portion 23, by taking the handle 63 by the fingers, the stopper member 17 may be pulled out from the cap holding portion 23.

Next, the operation of the toner bottle thus constructed is explained.

In the condition of the toner bottle before use, that is, in the condition shown in FIG. 1, since the stopper member 17 is mounted to the cap holding member 23, downward movement of the cap member 15 is prevented by the stopper member 17. Therefore, the position of the toner supply port 29 and the position of the opening 51 never coincide with each other. In other words, since the toner supply port 29 is always closed by the cap member 15, toner never spill out of the toner supply portion 29.

In addition, since the latching claws 31*a* and 31*b* are latched in the second groove 46, the cap member 25 does not come off the cap holding portion 23. That is, the projection amounts of the latching claws 31*a* and 31*b* become smaller toward the upper side, the second groove 46 is formed so as to be shallower toward the upper side, and the latching claws 31*a* and 31*b* are latched in the second groove 46, so that the cap member 15 never move upward with respect to the cap holding portion 23 although it may move downward.

Figure 8:
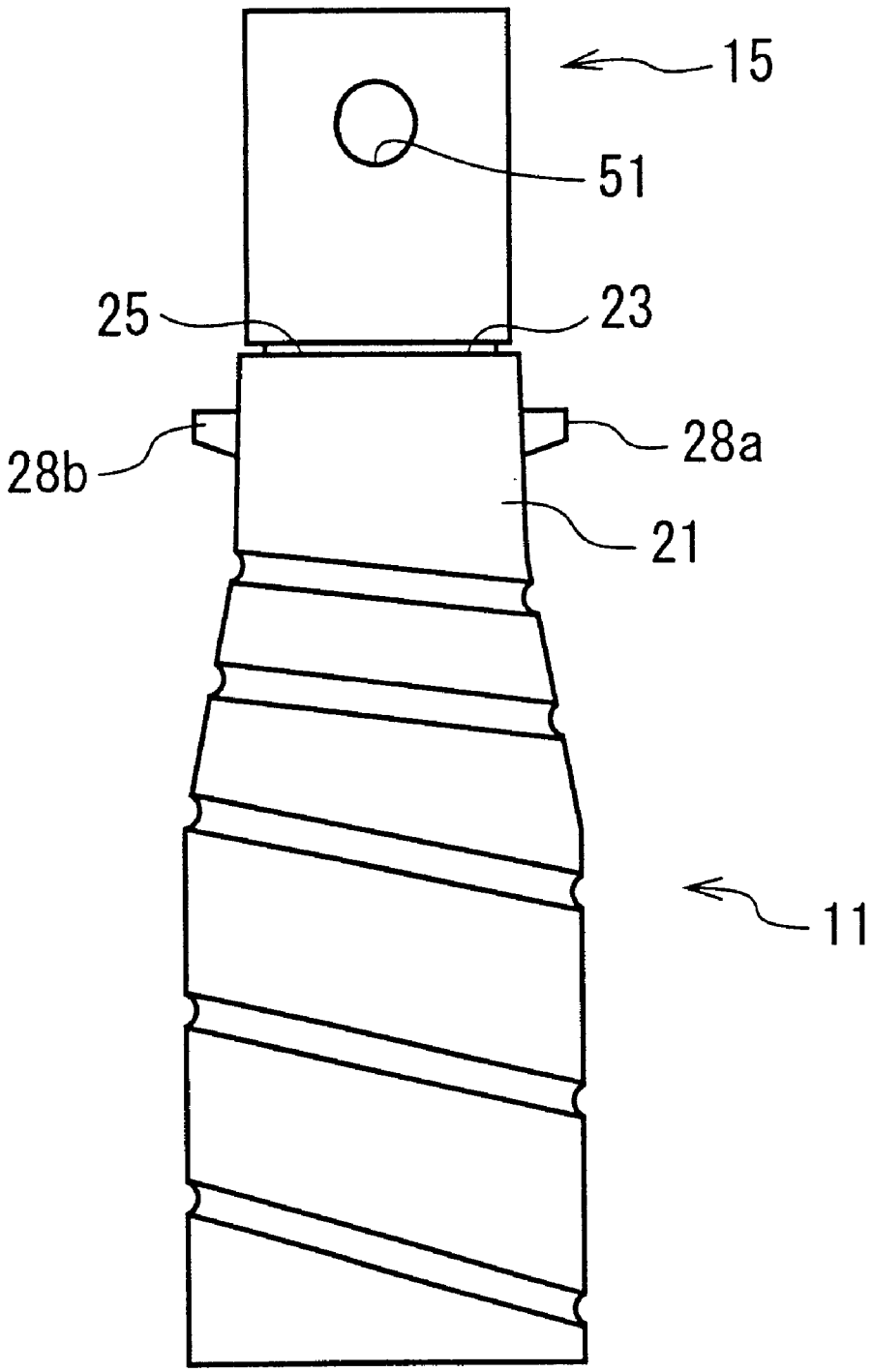
FIG. 8 is a front view showing a condition where the toner bottle according to the embodiment of the present invention is attached to a development apparatus.

FIG. 8 is a front view showing a condition where the toner bottle according to the embodiment of the present invention is attached to a development apparatus.

The stopper member 17 is removed immediately before attaching the toner bottle to the development apparatus.

Then, when the toner bottle is strongly pressed into the development apparatus, the latching claws 31*a* and 31*b* are released from the second groove 46, and the cap member 15 is pressed into the stepped portion 25 side of the bottle main body 11. As a result, the latching claws 31*a* and 31*b* are latched into the first groove 45, and the height of the opening 51 and the height of the toner supply port 29 coincide with each other.

Next, the notched portion 49 is latched on a projection (not shown) inside the development apparatus to fix the rotation, and a finger is hooked on the projections 28*a* and 28*b* to rotate the bottle main body 11 itself, whereby the position of the opening 51 and the position of the toner supply port 29 are matched with each other. Thereby, toner housed in the bottle portion 21 can be supplied to the development apparatus.

Figure 9:
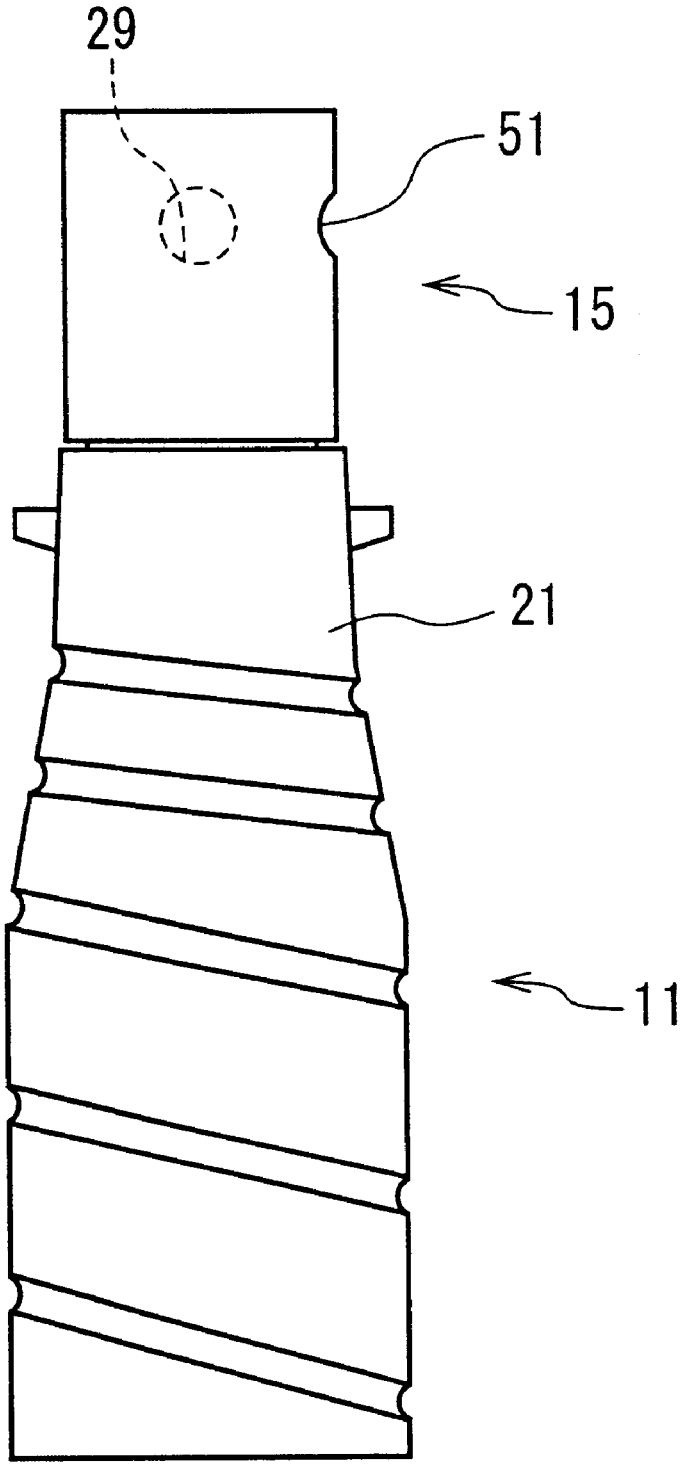
FIG. 9 is a front view showing a condition where the toner bottle according to the embodiment of the present invention is taken out from the development apparatus.

FIG. 9 is a front view showing a condition when the toner bottle relating to the embodiment of the invention is taken out of the development apparatus.

After supplying toner to the development apparatus, while the cap member 15 is fixed to the development apparatus, the bottle main body 11 is rotated by 90 degrees, for example. At this time, since the cap member 15 does not rotate, the cap member 15 rotates by 90 degrees with respect to the cap holding portion 23. As a result, the toner supply port 29 is closed by the cap member 15. Therefore, the position of the opening 51 and the position of the toner supply port 29 never coincide with each other thereafter.

According to the toner bottle of the embodiment, when attaching the toner bottle to a development apparatus, the toner bottle may be pushed into the development apparatus upon removing the stopper member 17, so that toner does not spill out during this operation. In addition, when detaching the toner bottle, the toner supply port 29 can be closed before detaching the toner bottle. Furthermore, after the toner supply port 29 is closed, the toner supply port 29 never opens, so that there is no fear of spilling toner remaining inside the bottle portion 21.

In the abovementioned embodiment, the cap member 15 is directly attached to the cap holding portion 23 of the bottle main body 11, however, a sealing member made from rubber or the like may be provided in the space between the cap member 15 and cap holding portion 23. This provision of the sealing member makes prevention from toner spilling more secure.

Opposite to the abovementioned embodiment, even a construction, in which the cap member 15 is rotated when attaching the toner bottle to a development apparatus, and the cap member 15 is pulled up when removing the toner bottle from the development apparatus, can obtain the same effects as in the abovementioned embodiment.

What is claimed is:

1. A toner bottle comprising:

a cylindrical bottle portion with an opening at one end, in said cylindrical bottle portion toner being housed;

a cylindrical cap holding portion connected to said opening of said bottle portion, said cap holding portion having a cylindrical body with a toner supply port formed for emitting said toner housed in said bottle portion, and a latching claw projecting from the outer surface of said cylindrical body at a position higher than said toner supply port; and a cap member attached to said cap holding portion in a manner enabling itself to slide in the peripheral direction and the axial direction of said cap holding portion, first and second grooves extending in the peripheral direction to which said latching claw is latched being formed in the inner surface of said cap member, and an opening from which said toner housed in said bottle portion is emitted being formed to said cap member between said first and second grooves.

2. The toner bottle according to claim 1, wherein said first groove is positioned higher than said opening, and the distance between said opening and first groove is shorter than the distance between said opening and second groove.

3. The toner bottle according to claim 1, wherein a notch for fixation to a development apparatus is formed on the outer surface of said cap member.

4. The toner bottle according to claim 1, wherein the outer diameter of said cap holding portion is smaller than the inner diameter of said opening of the bottle portion, and a step exists between said bottle portion and cap holding portion.

5. The toner bottle according to claim 4, further comprising a stopper member which is attachable and detachable to and from said cap holding portion, said stopper member being attached between the lower end of said cap member and said step before use.

6. The toner bottle according to claim 5, wherein said stopper member is made from a resin material having elasticity.

7. The toner bottle according to claim 6, wherein said stopper member comprises a stopper portion for holding said cap holding portion and a handle projecting outward from the center of both ends of said stopper portion.

8. The toner bottle according to claim 1, which further comprising a projection projecting from said bottle portion.

9. The toner bottle according to claim 1, wherein said latching claw and said first and second grooves are formed so that said first and second grooves prevent said cap member from moving upward over said latching claw after said latching claw is latched in either said first groove or said second groove.

10. The toner bottle according to claim 1, wherein said first groove is positioned higher than said opening, and said cap member is provided with a claw projecting from the lower part of said first groove.

11. The toner bottle according to claim 1, further comprising a sealing member provided between said cap member and cap holding portion.

* * * * *